US006921616B2

(12) United States Patent
Yamazaki et al.

(10) Patent No.: US 6,921,616 B2
(45) **Date of Patent: *Jul. 26, 2005**

(54) ELECTROSTATIC PHOTOGRAPHIC IMAGE FORMING METHOD

(75) Inventors: Hiroshi Yamazaki, Hachioji (JP); Hiroyuki Yamada, Tsukui-machi (JP); Ken Ohmura, Hachioji (JP)

(73) Assignee: Konica Corporation, Tokyo (JP)

( * ) Notice: Subject to any disclaimer, the term of this patent is extended or adjusted under 35 U.S.C. 154(b) by 108 days.

This patent is subject to a terminal disclaimer.

(21) Appl. No.: 10/452,487

(22) Filed: May 30, 2003

(65) Prior Publication Data

US 2003/0228533 A1 Dec. 11, 2003

(30) Foreign Application Priority Data

Jun. 6, 2002 (JP) ..... 2002-165903

(51) Int. Cl.[7] ..... G03G 13/01

(52) U.S. Cl. ..... 430/45; 430/47

(58) Field of Search ..... 430/45, 47

(56) References Cited

U.S. PATENT DOCUMENTS 6,780,558 B2 * 8/2004 Yamada et al. ..... 430/124

* cited by examiner

*Primary Examiner*—John L Goodrow
(74) *Attorney, Agent, or Firm*—Squire, Sanders & Dempsey

(57) ABSTRACT

A color image forming method is disclosed. The following steps are repeated; the steps for forming a latent image on a photoreceptor and developing the latent image by a developer to form a color toner image on the photoreceptor; collectively transferring the color toner image onto an image support; and fixing the transferred toner image; and a toner having a variation coefficient of the shape coefficient of not more than 16% and the number variation coefficient in the number particle diameter distribution of not more than 27% is employed.

20 Claims, 9 Drawing Sheets

TONER HAVING NO CORNERS

TONER HAVING CORNERS

TONER HAVING CORNERS

ELECTROSTATIC PHOTOGRAPHIC IMAGE FORMING METHOD

FIELD OF THE INVENTION

The invention relates to an electrostatic photographic image forming method using the toner.

BACKGROUND OF THE INVENTION

For forming a color image, a method has been known by which a latent image corresponding to a color is formed on one static image carrying member, usually an electrophotographic photo receptor (sometimes simply referred to as a photo receptor), and developed and transferred, and such the process is repeated for each of colors to form the color image.

In such the color image forming method, the latent image carrying member is uniformly charged and given the first exposure; this formed latent image is developed to form the first image. Then the second uniform charge is given to the latent image carrying member without the transferring of the first developed image, and the second latent image is formed by the second exposure and developed by the second development to form the second image on the latent image carrying member. In the case of full color printing, such the processes are performed as to each of colors of yellow, magenta, cyan and black, the colors are referred each to as the unit color, to form a full color image constituted by the four colors on the latent image carrying member. The toner image is collectively transferred onto an image supporting material such as a paper sheet and fixed to form the image.

As another method for forming a full color image, a method is known in which latent image carriers are prepared for each of the colors and the images formed on each of the latent image carriers are repeatedly transferred onto the same area of the image supporting member to form the full color image.

This method has an advantage that the method corresponds to a high speed image formation since the latent image forming process and the developing and transferring processes are prepared for each of the color units and the speed for the monochromatic image is the same as the speed for forming the full color image. In this method, it is necessary to stabilize the developing amount for controlling the color balance since the color images of each color units are separately formed on the latent image forming members different from each other. Moreover, a problem is raised on the stability of the final image quality when the adhesiveness of the toner of the color units are different from each other since the toner images each formed on each of the latent image carriers are transferred to the image support and fixed to form the image. Furthermore, the difference of the position between each of the color units tends to be occurred on the transfer and the problem of the disagreement of the color image position is caused. Consequently, it is difficult to stably form the images for a long period.

Besides, an usual toner prepared by the crashing method causes a problem of lowering the color reproducibility of the color image since the material dispersed in the toner is not uniformly distributed at the crashed surface of the toner and the surface property of the each of the toner particle is difficultly to be the same, consequently, the stabilization of the adhering amount of toner and the unifying the adhesiveness of each of the color units can be difficultly realized.

Therefore, the toner prepared by the polymerization method so called as the polymerized toner is recently noticed. Among the polymerized toners, a suspension polymerized toner is expected to have a high uniformity of the toner particles since the toner particle produced by such the method has a sphere shape and a uniform surface property. However, the sphere-shaped toner tends to cause lowering the transferring ability and the shedding of image on fixing since such the particle shows excessive adhesiveness to the static latent image carrying member and the image support.

Namely, the stable formation of the image for a long period and the stability depending on the environmental condition cannot be obtained in the process of the successively transferring the images each formed on the latent image carrying members by the method for forming the full color image, so called as tandem method, using the static latent image carrying members for each of the color units.

The method by which plural toner images are formed on the photoreceptor and collectively transferred onto the image support such as a paper sheet using no intermediate transferring member has an advantage such as that the apparatus can be made compact. However, problems are raised on the method such as that the roughing of the image is occurred on the transfer and the mixing of the different color toners is occurred on the image formation. Therefore, it is difficult to obtain sufficient images for a long period.

SUMMARY OF THE INVENTION

The invention is carried out on the above-mentioned background.

An object of an embodiment of the invention is to provide a developer for developing a static latent image and an image forming method using toner by which an image with high color reproducibility can be stably formed for a long period by a color image forming process in which images of plural color units are formed on a static latent image carrying member and the images are collectively transferred on a image support and fixed.

In the image forming method relating to the invention, the static latent image carrying member, called the photoreceptor carrying a toner image thereon, is subjected to a uniform charging, exposing and developing treatment. Accordingly, the charge for uniformly charging is given for plural times to the toner image formed on the photoreceptor.

It has been found by the inventors that the excessive electric charge of the toner causes the problem on the image quality in such the image forming method. Namely, it is discovered that the toner is scattered or mixed with another color toner at the time of the transferring of the developing of another color image when the influence of the charge is not uniform on the occasion of the re-charging onto the toner image formed on the photoreceptor. Such the phenomenon is considerably occurred when the difference of the shape of the toner particles is large or the diameter distribution is wide.

Furthermore, it has been found that an excessive charge tends to occur on a toner particle having a sharp corner since the charge is concentrated at the corner portion. As a result of that, problems such as disorder of the transfer, scatter of the toner and color mixing occur.

However, when the true spherical toner is used for solving the problem, it is found that any good image cannot be obtained since the adhesive force of the toner is increased and uneven transfer is occurred when the charge is repeatedly given to the spherical toner.

The invention is attained based on the above-mentioned results of the investigation by the inventors.

By the invention, an image with a high sharpness and color reproducibility can be formed for a long period by specifying and making uniform the shape and the particle diameter of the toner in the image forming method by which plural toner images are formed on the photoreceptor and collectively transferred onto the image support such as a paper sheet and fixed.

1. An electrostatic photographic image forming method comprising steps of;

forming a first color image on a photoreceptor by a method comprising the steps of forming a latent image corresponding to the first color image on the photoreceptor and developing the latent image by a developer containing a toner having the first color;

forming another color image on the photoreceptor having the first color image by a method comprising the steps of forming another latent image corresponding to another color image and developing the latent image by a developer containing a toner having another color;

transferring the color images formed on the photoreceptor to an image support; and fixing the transferred toner image, wherein each of the toner having the first color and the toner having another color contains a resin and a colorant, and comprises toner particles having a variation coefficient of the shape coefficient of not more than 16% and the number variation coefficient in the number particle diameter distribution of not more than 27%.

2. The electrostatic photographic image forming method described in the above item 1, wherein forming a first color image on a photoreceptor by a method comprising the steps of forming a latent image corresponding to a first color image on the photoreceptor and developing the latent image by a developer containing a toner having the first color;

forming, on the photoreceptor having the first toner image, a second, a third and a fourth toner images by a method each comprising the steps of forming a latent image corresponding to a second, a third or a fourth color image and developing the latent image by a developer containing a toner having a corresponding color, respectively, and each of the toner having the first, second, third and fourth colors contains a resin and a colorant, and comprises toner particles having a variation coefficient of the shape coefficient of not more than 16% and the number variation coefficient in the number particle diameter distribution of not more than 27%.

3. The electrostatic photographic image forming method described in the above item 1, wherein a ratio of toner particles having a shape coefficient of from 1.2 to 1.6 is not less than 65% in number in each of the toner having the first color and the toner having another color.

4. The electrostatic photographic image forming method described in the above item 1, wherein a ratio of the toner particle having no corner is not less than 50% in number in each of the toner having the first color and the toner having another color.

5. The electrostatic photographic image forming method described in the above item 1, wherein a number average diameter of the toner particle is from 3 to 8 $\mu$m in each of the toner having the first color and the toner having another color.

6. The electrostatic photographic image forming method described in the above item 1, wherein a number based histogram, in which natural logarithm lnD is taken as the abscissa and said abscissa is divided into a plurality of classes at an interval of 0.23, a toner exhibits at least 70 percent of the sum (M) of the relative frequency ($m_1$) of toner particles included in the highest frequency class, and the relative frequency ($m_2$) of toner particles included in the second highest frequency class wherein D is diameter of toner particles in each of the toner having the first color and the toner having another color.

7. The electrostatic photographic image forming method described in the above item 2, wherein the toners having first, second, third and fourth colors are selected from the group consisting of a yellow, magenta, cyan and black toners.

8. The electrostatic photographic image forming method described in the above item 7, wherein the yellow, the magenta, the cyan and the black toners satisfy a condition of $$0 \leqq R1 \leqq 0.20$$

wherein R1≦{(The maximum value of Ky, Km, Kc and Kb)−(The minimum value of Ky, Km, Kc and Kb)}/(The maximum value of Ky, Km, Kc and Kb), and Ky, Km, Kc and Kb each represents a shape coefficient of the yellow, the magenta, the cyan and the black toner, respectively.

9. The electrostatic photographic image forming method described in the above item 7, wherein the yellow, the magenta, the cyan and the black toners satisfy a condition of $$0 \leqq R2 \leqq 0.30$$

wherein R2≦{(The maximum value of Kσy, Kσm, Kσc and Kσb)−(The minimum value of Kσy, Kσm, Kσc and Kσb)}/(The maximum value of Kσy, Kσm, Kσc and Kσb), and Kσy, Kσm, Kσc and Kσb each represents a variation coefficient of a shape coefficient of the yellow, the magenta, the cyan and the black toner, respectively.

10. The electrostatic photographic image forming method described in the above item 7, wherein the yellow, the magenta, the cyan and the black toners satisfy a condition of $$0 \leqq R3 \leqq 0.15$$

wherein R3≦{(The maximum value of Dy, Dm, Dc and Db)−(The minimum value of Dy, Dm, Dc and Db)}/(The maximum value of Dy, Dm, Dc and Db), and Dy, Dm, Dc and Db each represents a number average of diameter of the yellow, the magenta, the cyan and the black toner, respectively.

11. The electrostatic photographic image forming method described in the above item 7, wherein the yellow, the magenta, the cyan and the black toners satisfy a condition of $$0 \leqq R4 \leqq 0.25$$

wherein R4={(The maximum value of Dσy, Dσm, Dσc and Dσb)−(The minimum value of Dσy, Dσm, Dσc and Dσb)}/(The maximum value of Dσy, Dσm, Dσc and Dσb), and Dσy, Dσm, Dσc and Dσb each represents a number variation coefficient of a number distribution of diameter of the yellow, the magenta, the cyan and the black toner, respectively.

A toner for developing a static latent image to be used in an image forming method comprising the steps of repeating the steps for forming a latent image on a photoreceptor and developing the latent image by a developer to form a color toner image on the photoreceptor; collectively transferring the color toner image onto an image support; and fixing the transferred toner image, wherein the toner contains a resin and a colorant, and the toner comprises toner particles having a variation coefficient of the shape coefficient of not more than 16% and the number variation coefficient in the number particle diameter distribution of not more than 27%.

The toner employed in this invention is preferably prepared by a method comprising a process of polymerizing a monomer in a water based medium.

The toner employed in this invention is preferably prepared by a method comprising a process of salting-out/fusing resin particles in a water based medium.

BRIEF DESCRIPTION OF THE DRAWING

FIG. 9(*b*) is a cross-sectional view of the reaction apparatus shown in FIG. 9(*a*).

FIGS. 11(*b*) and 11(*c*) are explanatory views showing projection images of toner particles having corners.

DETAILED DESCRIPTION OF THE INVENTION

The embodiments of the invention, the image forming apparatus to be used in the invention and the toner for developing the static latent image, also simply referred to as the toner, are described below.

The image forming method and the apparatus relating to the invention are described.

1. The Image Forming Method and the Image Forming Apparatus Relating to the Invention For example, a full color toner image is formed by firstly developing by a yellow toner, secondarily developing by a magenta toner, thirdly developing by a cyan toner and fourthly developing by a black toner.

Figure 12:
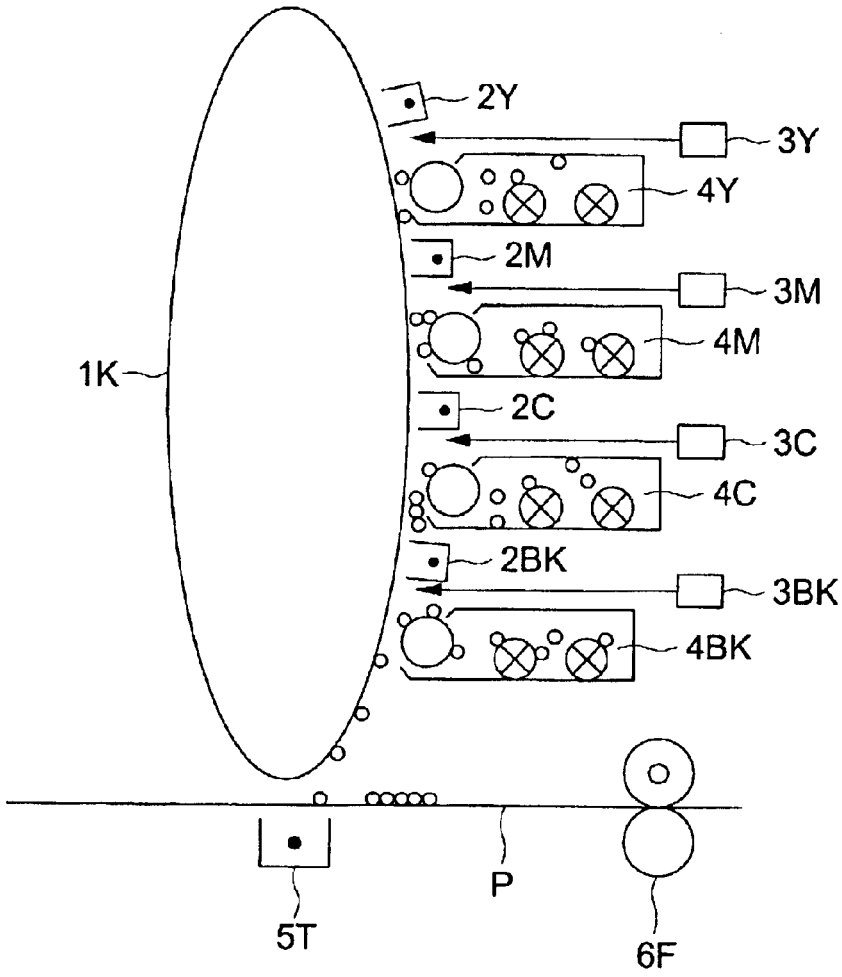
FIG. 12 is a schematic view showing a part of an image forming apparatus having four developing devices.

FIG. 12 shows a schematic cross section of a full color image forming apparatus relating to the invention.

Charging devices for uniformly charging 2Y, 2M, 2C and 2Bk for each of colors yellow Y, magenta M, cyan C and black Bk are arranged around a photoreceptor as a static latent image carrying member 1K. Furthermore, image wise exposing devices 3Y, 3M, 3C and developing devices 4Y, 4M, 4C and 4Bk are also arranged.

A yellow unit image is formed on the photoreceptor 1K by the uniformly charging device 2Y, the image exposing device 3Y and the developing device 4Y which are adjacently arranged. The procedure of the image formation is the same as in a mono color image forming apparatus. The surface of the photoreceptor 1K is uniformly charged by the uniformly charging device 2Y, the charged surface is image-wise exposed to light by the image exposing device 3Y and the developed by the developing device 4Y in which the yellow toner is charged to form the yellow image.

A magenta image, cyan image and black image are formed on the same area of the photoreceptor synchronized with the rotation of the photoreceptor 1K. Thus a full color image is formed by piling each of the images of color units.

The photoreceptor is continuously rotated and the full color toner image carried by the photoreceptor is transferred by a transferring device 5T onto an image support P synchronously conveyed with the rotation of the photoreceptor. Then the image support P carrying the full color toner image is conveyed to a fixing device 6F and the toner image is fixed onto the image support.

The photoreceptor is further rotated after the transferring of the toner image, and the toner and paper powder remaining on the photoreceptor are removed by a cleaning device, not shown in the drawing, to reuse the photoreceptor for image formation.

A good image cannot be obtained by a usual toner having a wide distribution of the diameter and shape. In the case of the toner according to the invention, the difference of the adhering force between the toner particles and the color mixing is not occurred since the toner comprises particles are uniform in the shape and particle diameter thereof and have no corner. Consequently, the suitable image can be obtained since the advantage of image forming method applying the collective image transfer with a small number of times of the transfer and inhibited occurrence of the disordering of image is enhanced.

2. Shape of Toner

The toner for developing a static image to be used in the invention or toner of the invention is described below.

The toner has the number ratio of toner particles having no corners is preferably 50 percent and the number variation coefficient in the number size distribution is preferably adjusted to not more than 27 percent.

The toner preferably employed in the present invention has a number ratio of toner particles having a shape coefficient of 1.2 to 1.6 and is at least 65 percent, and further the variation coefficient of said shape coefficient is not more than 16 percent.

The shape coefficient of the toner particles, which represents the roundness of toner particles, is expressed by the formula described below.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

In one of the embodiment of the invention the toner preferably has a number ratio of toner particles having a shape coefficient of 1.0 to 1.6 and is at least 65 percent, and more preferably 70 percent or more, and further number ratio of toner particles having a shape coefficient of 1.2 to 1.6 and is at least 65 percent, and particularly preferably 70 percent or more.

According to such characteristics as shape coefficient and number ratio of toner particles high toner filling density in a toner layer which is transferred to an intermediate transfer material is obtained, fluctuation of transfer characteristics of toner between different colors at the second image transfer process to an image forming support is reduced, and therefore, a good transfer characteristics is obtained. Further variation of adhesion property in each color is lowered and therefore a color image can be obtained stably since the toner particle is not easily crashed, stain on the charging member is reduced and charging characteristics of the toner becomes stable.

The polymerized toner of the present invention is that the number ratio of toner particles in the range of said shape coefficient of 1.2 to 1.6 is preferably at least 65 percent and is more preferably at least 70 percent.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The toner obtained by polymerization method is preferable in view of simple preparation and excellent in uniform surface property comparing with the pulverized toner.

Variation Coefficient

The variation coefficient of the polymerized toner is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

The variation coefficient is preferably not more than 16%, and more preferably not more than 14% in the present invention. Gaps between toner particles in the toner layer are reduced, the transfer characteristics are minimized at the second transfer to the image forming support and therefore good image transfer characteristics are obtained. Further image characteristics are improved because sharp charging distribution is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

Number Variation Coefficient

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution. The number variation coefficient in the number particle distribution of toner is calculated employing the formula described below:

$$\text{Number variation coefficient}=(S_2/D_n)\times 100 \text{ (in percent)}$$

wherein $S_2$ represents the standard deviation in the number particle size distribution and $D_n$ represents the number average particle diameter (in $\mu$m).

The number variation coefficient of the toner of the present invention is not more than, preferably, 27 percent, and is more preferably not more than 25 percent. By adjusting the number variation coefficient to not more than 27 percent, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

Population of Toner Particles Having No Corner

The number ratio of toner particles having no corners is preferably at least 50 percent, and or more preferably at least 70 percent.

By adjusting the number ratio of toner particles having no corner as above, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency since number of toners which are prone to be wore or crashed and have charge concentration portions reduces.

Figure 11:
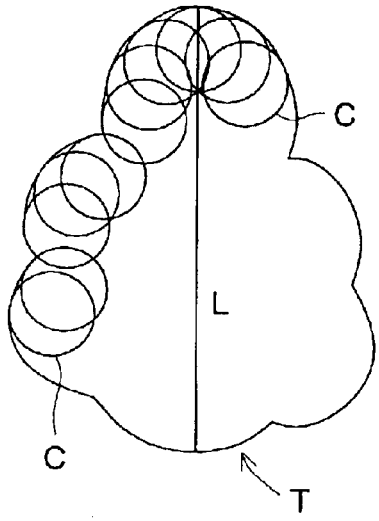
FIG. 11(*a*) is an explanatory view showing a projection image of toner particle having no corners.
Figure 11:
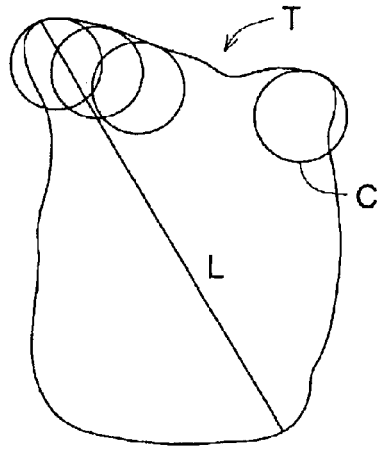
Figure 11:
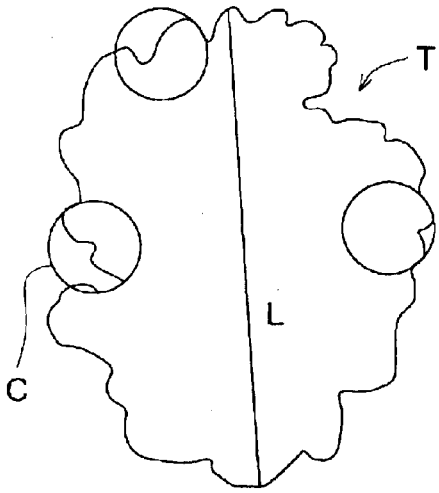

The toner particles of the present invention, which substantially have no corners, as described herein, mean those having no projection to which charges are concentrated or which tend to be worn down by stress. Namely, as shown in FIG. 11(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 11(*b*) and 11(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

In the invention, the color reproducibility is enhanced when the toner particles are uniform in the shape thereof in each of the yellow, magenta, cyan and black toners. Accordingly, it is preferable that the toners satisfy the following conditions.

When the relations of the shape coefficient Ky, the variation coefficient of the shape coefficient Kσy, the number average of diameter Dy and the number variation coefficient of the number distribution of diameter Dσy of the yellow toner, the shape coefficient Km, the variation coefficient of the shape coefficient Kσm, the number average of diameter Dm and the number variation coefficient of the number distribution of diameter Dσm of the magenta toner, the shape coefficient Kc, the variation coefficient of the shape coefficient Kσc, the number average of diameter Dc and the number variation coefficient of the number distribution of diameter Dσc of the cyan toner, and the shape coefficient Kb, the variation coefficient of the shape coefficient Kσb, the number average of diameter Db and the number variation coefficient of the number distribution of diameter Dσb of the black toner, satisfy at least one of the following conditions 1 through 4, the image forming method can be provided in which a good transferring ability can be held even when the transfer to the image forming support is performed through the intermediate transfer process.

Condition 1

$$0 \leqq R1 \leqq 0.20$$

wherein R1≦{(The maximum value of Ky, Km, Kc and Kb)−(The minimum value of Ky, Km, Kc and Kb)}/(The maximum value of Ky, Km, Kc and Kb)

Condition 2

$$0 \leqq R2 \leqq 0.30$$

wherein R2≦{(The maximum value of Kσy, Kσm, Kσc and Kσb)−(The minimum value of Kσy, Kσm, Kσc and Kσb)}/(The maximum value of Kσy, Kσm, Kσc and Kσb)

Condition 3

$$0 \leqq R3 \leqq 0.15$$

wherein R3≦{(The maximum value of Dy, Dm, Dc and Db)−(The minimum value of Dy, Dm, Dc and Db)}/(The maximum value of Dy, Dm, Dc and Db)

Condition 4

$$0 \leqq R4 \leqq 0.25$$

wherein R4={(The maximum value of Dσy, Dσm, Dσc and Dσb)−(The minimum value of Dσy, Dσm, Dσc and Dσb)}/(The maximum value of Dσy, Dσm, Dσc and Dσb)

Diameter of Toner Particles

The diameter of the toner particles of the present invention is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 μm, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

<Comparing with a Conventional Toner>

The toner according to the invention can be clearly distinguished from the conventional toner as to (a) the ratio of the toner particles having a shape coefficient within the range of from 1.2 to 1.6 (not less than 65% in number in the toner of the invention), (b) the variation coefficient of the shape coefficient (not more than 16% in the toner of the invention), (c) the ratio of the particles having no corner (not less than 50% in number in the toner of the invention), and (d) the number variation coefficient of the particle diameter distribution in number (not more than 27% in the toner of the invention).

The values described in (a) to (d), regarding the toner according to the invention, of the usually known toners are described below. The values are different accompanied with the producing method of the toner.

(Toner by Pulverizing Method)

In the case of the usually known toner produced by a pulverizing method, the ratio of the particles having a shape coefficient within the range of from 1.2 to 1.6 is approximately 60% in number. The variation coefficient of the shape coefficient of such the toner is about 20%. In the toner by the pulverizing method, the ratio of the toner particles having no corner is not more than 30% in number since the particle size is made small by repeating the crushing accordingly the corner is formed on many toner particles. Therefore, a treatment for making sphere the shape of the toner particle by heating is necessary for controlling the shape coefficient to obtain atoner particles each uniformly has a rounded shape without corner. The number variation coefficient of the particle diameter distribution in number is about 30% when the classifying after crushing is performed only once. The classifying operation has to be repeated to obtain the number variation coefficient of not more than 27%.

When toner is prepared employing a suspension polymerization method, conventionally, the polymerization is carried out in a laminar flow, resulting in toner particles having a nearly spherical shape. For example, in the toner described in Japanese Patent Publication Open to Public Inspection No. 56-130762, the ratio of toner particles having a shape coefficient of 1.2 to 1.6 is approximately 20 percent by number, and the variation coefficient of the shape coefficient is approximately 18 percent, while the ratio of toner particle have no corners is approximately 85 percent by number. Furthermore, as previously described in the method which controls a number variation coefficient in the number particle size distribution, large oil droplets comprised of polymerizable monomers are subjected to repeated mechanical shearing to reduce the size of the droplets to nearly a similar size as the desired toner particles. Therefore, the distribution of oil droplet diameter is broadened. As a result, the particle size distribution of the resulting toner widens. Therefore, in order to decrease the number variation coefficient, a classification operation is required.

When toner is prepared employing the polymerization method in which resin particles are associated or fused, for example, toner described in Japanese Patent Publication Open to Public Inspection No. 63-186253 comprises approximately 60 percent by number of toner particles having a shape coefficient of 1.2 to 1.6, its variation coefficient of the shape coefficient is approximately 18 percent and further, its ratio of toner particles having no corners is approximately 44 percent by number. Still further, the particle size distribution of said toner is wide and the number variation coefficient is 30 percent. Accordingly, in order to decrease the number variation coefficient, a classification operation is required.

4. Preparation of Toner Particle

The toner particles preferably employed in the invention are those obtained by polymerization of at least polymerizable monomer in an aqueous medium and by coagulation of at least resin particle in an aqueous medium. Examples of the method to prepare the toner will be described.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

The water based medium as described in the present invention means one in which at least 50 percent, by weight of water, is incorporated.

A method for preparing said toner may includes one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The concentration of coagulant may be not less than the critical coagulation concentration. However, the amount of the added coagulant is preferably at least 1.2 times of the critical coagulation concentration, and more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Growth of the particle size is terminated when the particle size reaches expected value. A metal salt or water is added for this purpose. Mono-valent metal salt such as sodium chloride or calcium chloride is employed as an example of the metal salt. These are added in an amount sufficient to terminate the growth of particle size.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

5. Compounds Composing Toner

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.T. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like. Example of the ester type wax includes carnauba wax, candelilla wax and microcrystalline wax.

The most preferable one is an ester represented by the following formula.

$$R^1—(OCO—R^2)_n$$

In the Formula (1) n is an integer of 1 to 4, preferably 2 to 4, more preferably 3 or 4, in particular preferably 4.

$R^1$ and $R^2$ each represent a hydrocarbon group which may have a substituent. Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Examples of the ester wax are listed.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

8)

$$CH_3—(CH_2)_{22}—COO—CH_2—\underset{CH_3}{\overset{CH_3}{\overset{|}{\underset{|}{CH}}}}—CH_2—O—CO—(CH_2)_{22}—CH_3$$

9)

$$CH_3—(CH_2)_{26}—COO—CH_2—\underset{CH_3}{\overset{CH_3}{\overset{|}{\underset{|}{CH}}}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$CH_3—(CH_2)_{26}—COO—CH_2—\overset{CH_3}{\overset{|}{\underset{CH_2—O—CO—(CH_2)_{26}—CH_3}{\underset{|}{C}}}}—CH_2—O—CO—(CH_2)_{26}—CH_3$$

17)

$$CH_3—(CH_2)_{20}—COO—CH_2—\overset{CH_2CH_3}{\overset{|}{\underset{CH_2—O—CO—(CH_2)_{20}—CH_3}{\underset{|}{C}}}}—CH_2—O—CO—(CH_2)_{20}—CH_3$$

-continued

18)

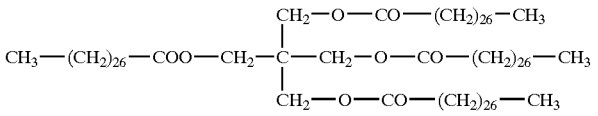

19)

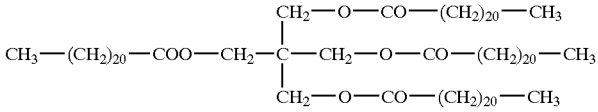

20)

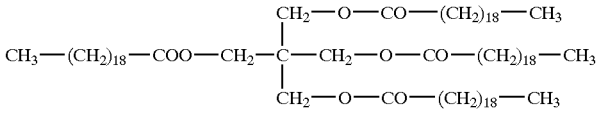

21)

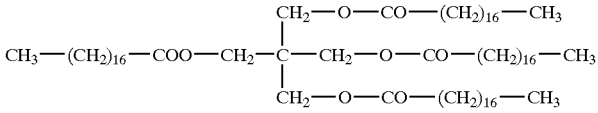

22)

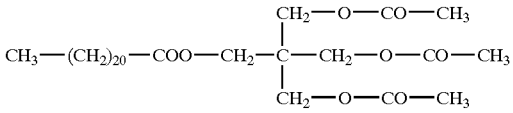

The content ratio of releasing agents in the toner is commonly 1 to 30 percent by weight, is preferably 2 to 20 percent by weight, and is more preferably 3 to 15 percent by weight.

The ester wax is preferably employed since it improves transferred image quality as well as fixing property. Though the reason has not been clearly investigated, it is assumed that minute amount of this ester wax moves to a surface of a photoreceptor during the development or cleaning process to reduce the surface energy of the photoreceptor, and it improves transfer property as its result.

The releasing agent is incorporated in the toner particle in such a way that the releasing agent and the resin particles are subjected to salting out/fusing as well as colored particles, or the releasing agent is dissolved in a monomer to form resin particles and then the monomer is polymerized.

Employed as charge control agents may also be various types can be dispersed in water. Specifically listed are nigrosine dyes, metal salts of naphthenic acid or higher fatty acids, alkoxylated amines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

6. Preparation Apparatus

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Figure 1:
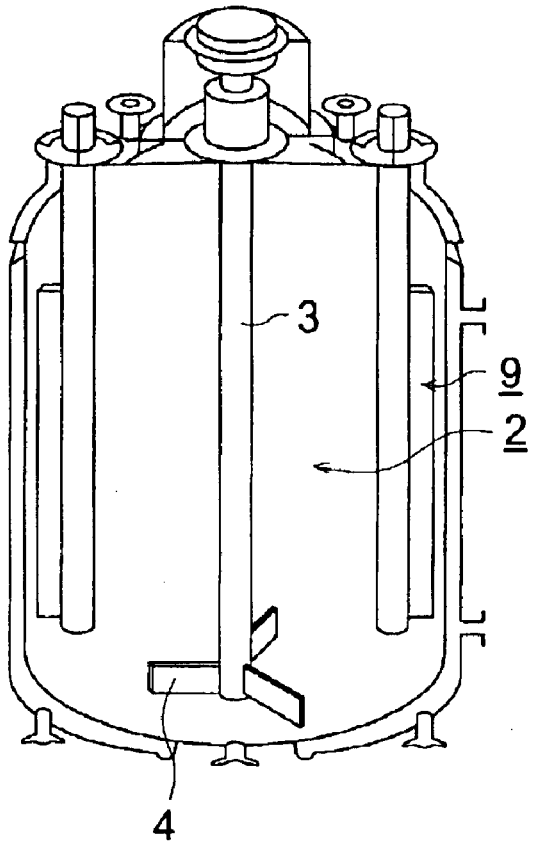
FIG. 1 is a view explaining a reaction apparatus having one level configuration of the stirring blade.

FIG. 1 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
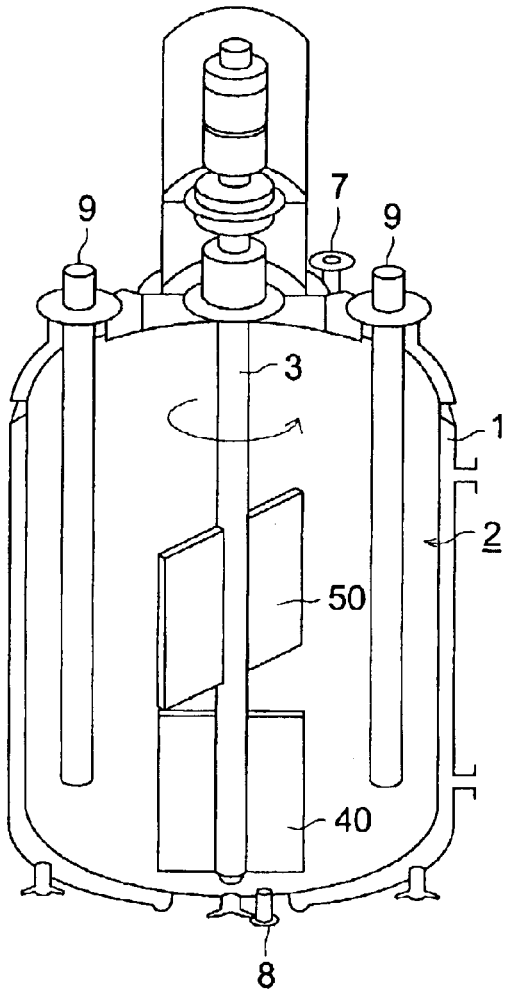
FIG. 2 is a perspective view showing one example of a reaction apparatus which is provided with preferably employable stirring blades.
Figure 3:
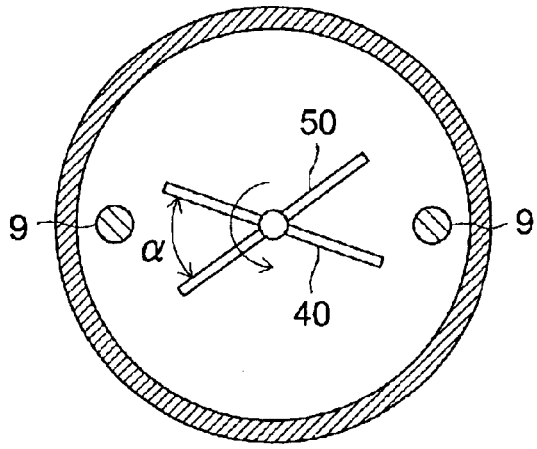
FIG. 3 is a cross-sectional view of the reaction apparatus shown in FIG. 2.

FIGS. 2 and 3 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

In FIGS. 2 and 3, arrows show the rotation direction, reference numeral 7 is upper material charging inlet, 8 is a lower material charging inlet, and 9 is a turbulent flow forming member which makes stirring more effective.

Figure 10:
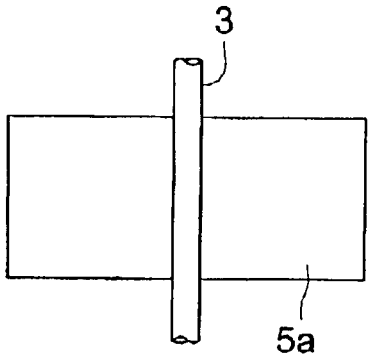
FIG. 10 is a schematic view showing a specific example of the shape of a stirring blade.
Figure 10:
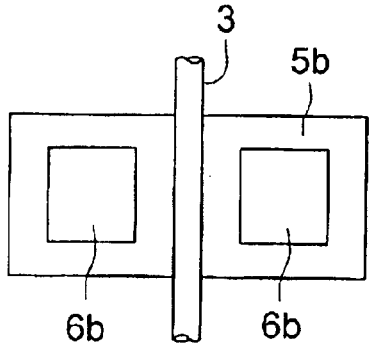
Figure 10:
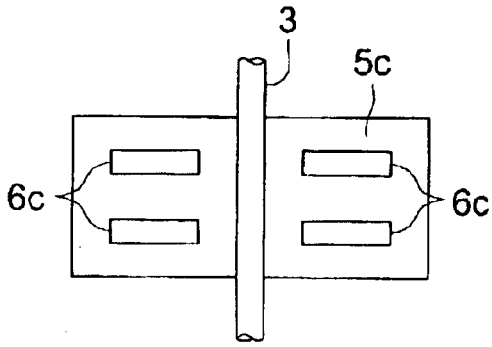
Figure 10:
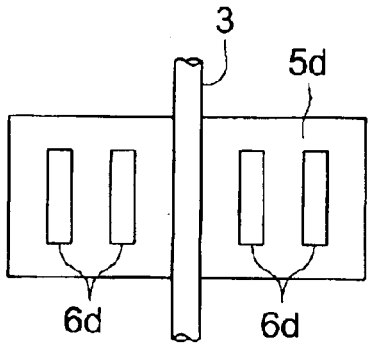

Herein, the shape of the stirring blades is not particularly limited, but employed may be those which are in square plate shape, blades in which a part of them is cut off, blades having at least one opening in the central area, having a so-called slit, and the like. FIGS. 10(*a*) to 12(*d*) describes specific examples of the shape of said blades. Stirring blade 5*a* shown in FIG. 10(*a*) has no central opening; stirring blade 5*b* shown in FIG. 10(*b*) has large central opening areas 6*b*; stirring blade 5*c* shown in FIG. 10(*c*) has rectangular openings 6*c* (slits); and stirring blade 5*d* shown in FIG. 10(*d*) has oblong openings 6*d* shown in FIG. 10(*d*). Further, when stirring blades of a three-level configuration are installed, openings which are formed at the upper level stirring blade and the openings which are installed in the lower level may be different or the same.

FIGS. 4 through 8 each show a perspective view of a specific example of a reaction apparatus equipped with stirring blades which may be preferably employed. In FIGS. 4 through 8, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 4:
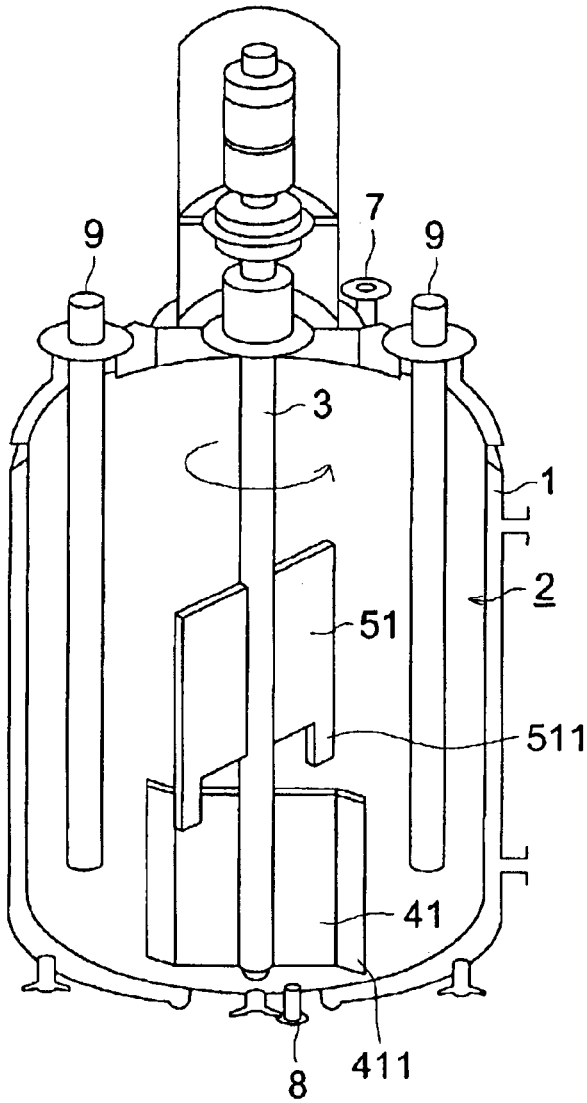
FIG. 4 is a perspective view showing a specific example of a reaction apparatus provided with the preferably employable stirring blades.

In the reaction apparatus shown in FIG. 4, folded parts 411 are formed on stirring blade 42 and fins 511 (projections) are formed on stirring blade 51.

Further, when said folded sections are formed, the folded angle is preferably between 5 and 45 degrees.

Figure 5:
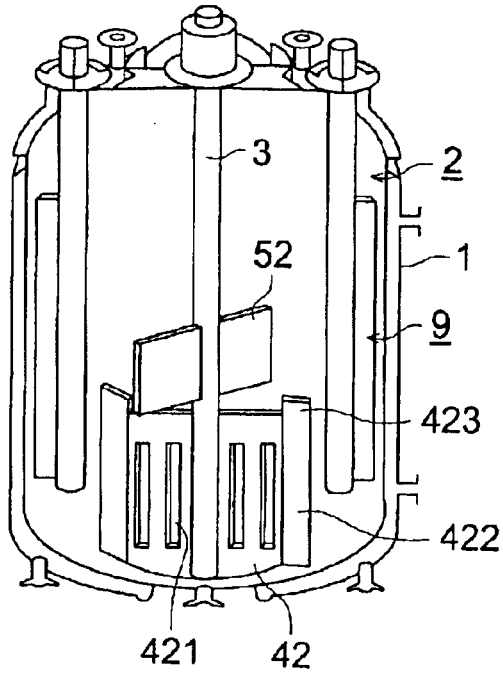
FIG. 5 is a perspective view showing a specific example of a reaction apparatus provided with the preferably employable stirring blades.

In stirring blade 42 which constitutes the reaction apparatus shown in FIG. 5, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 2.

Figure 6:
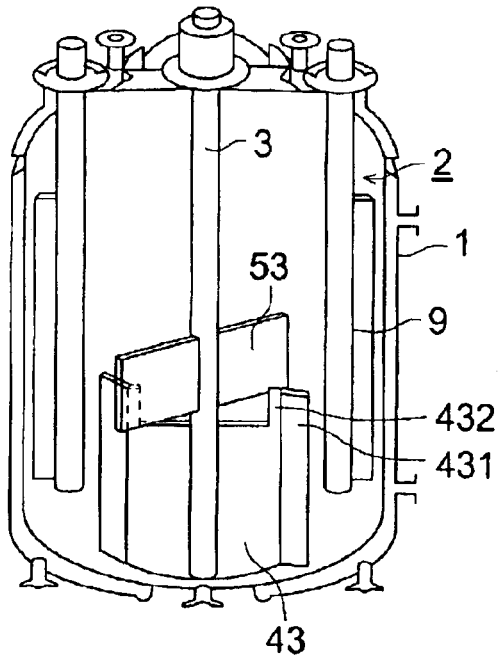
FIG. 6 is a perspective view showing a specific example of a reaction apparatus provided with the preferably employable stirring blades.

In stirring blade 43 which constitutes part of the reaction apparatus shown in FIG. 6, folded section 431 as well as fin 432 is formed.

Further, stirring blade 53, which constitutes part of said reaction apparatus, has the same shape as stirring blade 50 which constitutes part of the reaction apparatus shown in FIG. 2.

Figure 7:
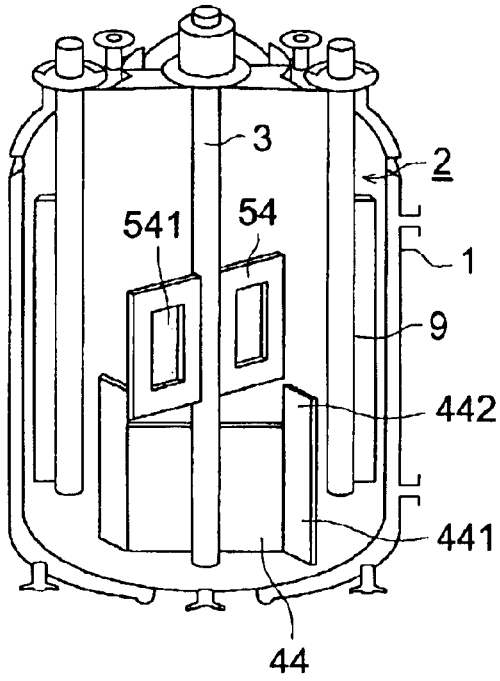
FIG. 7 is a perspective view showing a specific example of a reaction apparatus provided with the preferably employable stirring blades.

In stirring blade 44 which constitutes part of the reaction apparatus shown in FIG. 7, folded section 441 as well as fin 442 is formed.

Further, in the stirring blade 54 which constitutes part of said reaction apparatus, openings 541 are formed in the center of the blade.

Figure 8:
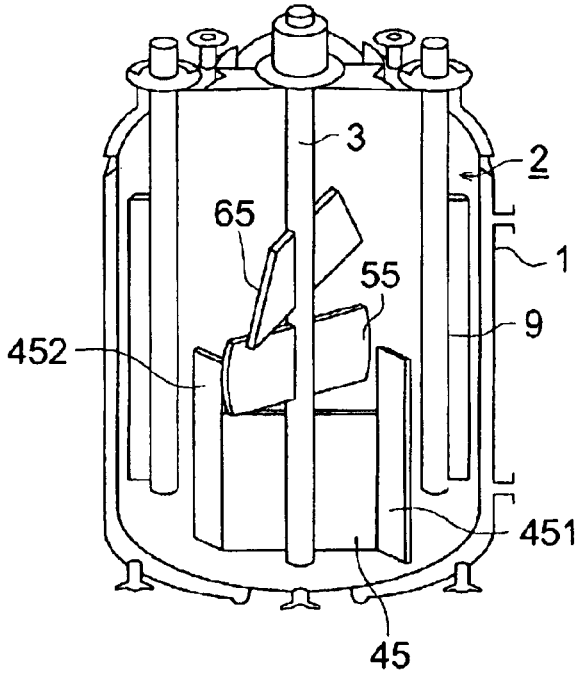
FIG. 8 is a perspective view showing a specific example of a reaction apparatus provided with the preferably employable stirring blades.

In the reaction apparatus shown in FIG. 8, provided are stirring blades at three-level comprised of stirring blade 45 (at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 9:
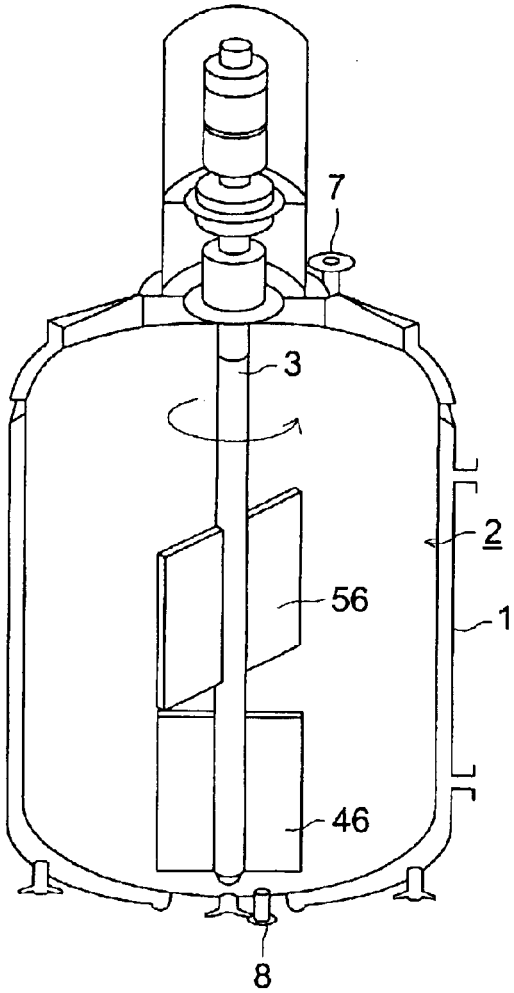
FIG. 9(*a*) is a perspective view showing one example of a reaction apparatus employed so that a laminar flow forms.
Figure 9:
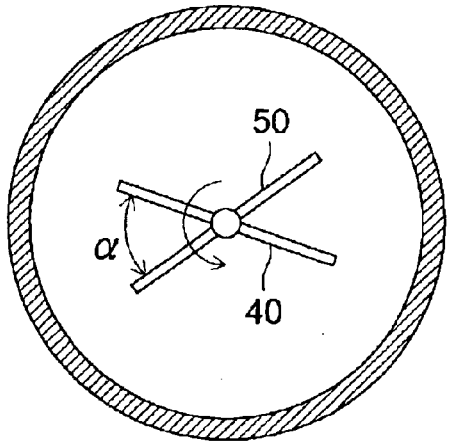

FIG. 9(*a*) shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56 shown in FIGS. 9(*a*) and 9(*b*), has the same shape as well as the crossed axis angle of stirring blade 40, as well as stirring blade 50 which constitutes part of the reaction apparatus shown in FIG. 2. In FIG. 9(*a*), reference numeral 1 is a heat exchange jacket, 2 is a stirring tank, 3 is a rotation shaft, 7 is an upper material charging inlet, and 8 is a lower material charging inlet.

Apparatuses, which are employed to form a laminar flow, are not limited to ones shown in FIG. 9(*a*).

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 9(*a*). Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 10(*a*), which are formed of a continuous plane are preferable, and those having a curved plane may also be employed.

7. Developing and Fixing Method

A non-contact developing method is preferable to form a toner image on a photosensitive material since a plurality of development is required for forming a color image. An alternative electric field is preferably applied in the developing process.

The toner of the present invention may be employed as either a single component developer by incorporating, for example, a magnetic material in a toner particle or a two-component developer by mixing with a carrier. It is preferably employed as a two-component developer.

Said magnetic particles used as carriers preferably have a volume average diameter of 15 to 100 $\mu$m, and more preferably have one between 25 to 60 $\mu$m. The volume average particle diameter of said carrier is typically measured employing a laser diffraction type particle distribution meter, HELOS (manufactured by Japan Laser Corporation) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

Toner images can be fixed preferably by a contacting thermal fixing method, whose example includes a thermo-pressure fixing, heat roll fixing, a pressure-heat fixing by a rotating pressure device containing a heater fixed therein.

EXAMPLES

The present inventing will now be detailed with reference to examples.

Preparation of Toner

Toner Preparation Example 1

An Example of Emulsion Polymerizing Association Method

Nonylphenol polyethylene oxide 10-mole adduct of 0.50 kg and 10.0 liters of pure water were charged, stirred and dissolved. MOGAL L (carbon black manufactured by Cabot Co.) of 1.20 kg was added gradually to the solution, and after sufficient stirring for 1 hour the system was dispersed continuously for 20 hours by use of a sand grinder (a media type dispersing apparatus). The resulting product was "colorant dispersion 1".

Further, a solution comprised of 0.055 kg of nonylphenol polyethylene oxide 10-mole adduct and 4.0 liters of ion-exchanged was "nonion surfactant solution A".

A solution comprised of 0.014 kg of nonylphenol polyethylene oxide 10-mole adduct and 4.0 liters of ion-exchanged was "nonion surfactant solution B".

A solution in which 223.8 g of potassium persulfate were dissolved in 12.0 liters of ion-exchanged water was "initiator solution C".

Into a GL (glass lining treated) reaction vessel having a volume of 100 liters and equipped with a temperature sensor, a cooling tube and a nitrogen introducing device, the whole amount of "anion surfactant solution A" and the whole amount of "nonion surfactant solution B" were added and stirring was started. Next, 44.0 liters of ion-exchanged water were added.

Heating was started and the total amount of "initiator solution C" was added drop-wise when the temperature reached 75° C. Thereafter, 12.1 kg of styrene, 2.70 kg of n-butyl acrylate, 1.14 kg of methacrylic acid, 1.5 kg of exemplified ester wax 19 and 550 g of t-dodecyl mercaptan were added drop-wise while controlling the temperature at 75° C.±1° C. After finishing the drop-wise addition the solution temperature was raised to 80° C.±1° C. and the system was stirred for 6 hours while being heated. Thereafter, the solution temperature was cooled down to not higher than 40° C. to stop stirring, and was filtered through a pole filter to obtain latex. This was "latex-A".

Herein, the resin particles in latex-A had a glass transition temperature of 58° C., a softening point of 119° C., a molecular weight distribution of 13,500 based on a weight average molecular weight, and a weight average particle diameter of 115 nm.

A solution in which 0.055 kg of sodium dodecylbenzene sulfonate was dissolved in 4.0 liters of ion-exchanged was "anion surfactant solution D".

Further, a solution in which 0.014 kg of nonylphenol polyethylene oxide 10-mole adduct were dissolved in 4.0 liters of ion-exchanged was "nonion surfactant solution E".

A solution in which 200 g of potassium persulfate were dissolved in 12.0 liters of ion-exchanged water was "initiator solution F".

Into a GL reaction vessel having a volume of 100 liters and equipped with a temperature sensor, a cooling tube, a nitrogen introducing device and a comb-shaped baffle, added were 3.41 kg of WAX emulsion (polypropylene emulsion having a number average molecular weight of 3000, number average primary particle diameter being 120 nm, solid concentration being 29.9%) and the whole amount of "anion surfactant solution D" and the whole amount of "nonion surfactant solution E", and stirring was started.

Next, 44.0 liters of ion-exchanged water were added. Heating was started and the total amount of "initiator solution F" was added drop-wise when the temperature reached 70° C. Thereafter, a solution, in which 11.0 kg of styrene, 4.00 kg of n-butyl acrylate, 1.04 kg of methacrylic acid and 9.0 g of t-dodecyl mercaptan had been mixed in advance, was added drop-wise. After finishing the drop-wise addition the solution temperature was controlled at 72° C.±2° C. and the system was stirred for 6 hours while being heated. Further, the solution temperature was raised up to 80° C.±2° C. and the system was stirred for 12 hours while being heated. The solution temperature was cooled down to not higher than 40° C. to stop stirring. The resulting solution was filtered through a pole filter to obtain a filtrate as "latex-B".

Herein the resin particles in latex-B had a glass transition temperature of 59° C., a softening point of 133° C., a molecular weight distribution of 245,000 based on a weight average molecular weight and a weight average particle diameter of 110 nm.

A solution, in which 5.36 kg of sodium chloride as a salting out agent were dissolved in 20.0 liters of ion-exchanged water, was "sodium chloride solution G".

A solution, in which 1.00 g of fluorine-contained nonion surfactant was dissolved in 1.00 liter of ion-exchanged water, was "nonion surfactant solution H".

Latex-A of 20.0 kg, 5.2 kg of latex-B and 0.4 kg of colorant dispersion, which were prepared above, and 20.0 kg of ion-exchanged water were charged in a 100-liter SUS reaction vessel equipped with a temperature sensor, a cooling tube, a nitrogen introducing device and a device to monitor a particle size and shape (a reaction apparatus of which construction is illustrated in FIGS. 9(*a*) and 9(*b*), a cross degree $\alpha$ is 25°) and the system was stirred. Next, the system was heated at 40° C., and sodium chloride solution G, 6.00 kg of isopropanol (manufactured by Kanto Kagaku Co.) and nonion surfactant solution H were added in this order. Thereafter, after the system was kept standing for 10 minutes heating was started, the solution temperature was raised up to 85° C. in 60 minutes, and particle diameter was grown up while being salted out/fused by being heated and stirred at 85° C.±2° C. for from 0.5 to 3 hours. Next, particle diameter growth was stopped by addition of 2.1 liters of pure water to prepare a fused particle dispersion.

The fused particle dispersion prepared above of 5.0 kg was charged in a 5-liter reaction vessel equipped with a temperature sensor, a cooling tube, and a device to monitor a particle size and shape (a reaction apparatus of which construction is illustrated in FIGS. 9(*a*) and 9(*b*), a cross degree $\alpha$ is 20°) and stirred while being heated at a liquid temperature of 85° C.±2° C. for from 0.5 to 15 hours to control the particle shape. Thereafter, the system was cooled down to not higher than 40° C., and stirring was ceased. Next, classification in a solution by a centrifugal sedimentation method was performed by use of a centrifuge and filtration through a sieve of 45 $\mu$m mesh was performed to obtain a filtrate, which was an associated liquid. Then, non-spherical particles of a wet cake state were filtered off from the associated liquid by use of a Buchner funnel. Thereafter, the particles obtained were washed by ion-exchanged water. The non-spherical particles were dried by use of a flash jet drier at a suction air temperature of 60° C., followed by being dried at a temperature of 60° C. by use of a fluid bed drier. Silica fine particles of 1 weight part was added and mixed by use of a Henschel mixer to 100 weight parts of colorant particles obtained above to prepare a black toner by means of an emulsion polymerizing association method.

In the monitoring of a salting out/fusing step and of a shape controlling process, a shape and a variation coefficient of a shape coefficient were controlled by controlling a stirring revolution and heating time, and further a particle size and a variation coefficient of a particle size distribution were adjusted arbitrary by classification in a solution to obtain toners Bk 1 through Bk 5 having specific shape characteristics and particle size distribution characteristics.

Toner Preparation Example 2

An Example of Emulsion Polymerizing Association Method

Yellow toners (Y toners 1 through 5) was obtained in the same way as Toner Preparation example 1, except that 1.05 kg of a colorant C.I. Pigment Yellow 93 was employed in place of carbon black. Y toners each has specific shape coefficient and particle distribution characteristics shown in Table 1.

Toner Preparation Example 3

An Example of Emulsion Polymerizing Association Method

Magenta toners (M toners 1 through 5) was obtained in the same way as Toner Preparation example 1, except that 1.20 kg of a Rhodamine magenta colorant C.I. Pigment Red 122 was employed in place of carbon black. M toners each has specific shape coefficient and particle distribution characteristics shown in Table 1.

Toner Preparation Example 4

An Example of Emulsion Polymerizing Association Method

Cyan toners (C toners 1 through 5) was obtained in the same way as Toner Preparation example 1, except that 0.60 kg of a phthalocyanine cyan colorant C.I. Pigment Blue 15:3 was employed in place of carbon black. C toners each has specific shape coefficient and particle distribution characteristics shown in Table 1.

Toner Preparation Example 5

Example of a Suspension Polymerization Method

A mixture comprised of 165 g of styrene, 35 g of n-butyl acrylate, 10 g of carbon black, 2 g of a di-t-butyl salicylic acid metal compound, 8 g of a styrene-methacrylic acid copolymer, and 20 g of crystalline ester wax (exemplified compound 19) were heated to 60° C., and uniformly dissolve dispersed employing a TK homomixer (manufactured by Tokushu Kika Kogyo Co.). Then, 10 g of 2,2'-azobis(2,4-valeronitrile) were added and dissolved, and a polymerizable monomer composition was prepared. Subsequently, to 710 g of deionized water, 450 g of 0.1M aqueous sodium phosphate solution were added, and 68 g of 1.0 M calcium chloride was gradually added to the resulting mixture while stirring at 13,000 rpm employing a TK homomixer, and a suspension, in which tricalcium phosphate had been dispersed, was prepared. The above-mentioned polymerizable monomer composition was added to the resulting suspension, and the resulting mixture was stirred at 10,000 rpm for 20 minutes employing a TK homomixer to granulate the polymerizable monomer composition. Thereafter, employing a reaction apparatus equipped with stirring blades constituted as shown FIG. 2 (having crossed axis angle α: 45°) the resulting particles underwent reaction at 75 to 95° C. for 5 to 15 hours. Tricalcium phosphate was dissolved and removed employing hydrochloric acid. Next, employing a centrifuge, classification was carried out utilizing a centrifugal sedimentation method, and filtration, washing, and drying were carried out. Toner prepared employing the suspension polymerization method was then obtained by externally adding one weight part of fine silica particles to 100 weight parts of the obtained colored particles by employing Henschel mixer. Black toner by suspension polymerization method was obtained.

During the above-mentioned polymerization, monitoring was carried out, and by controlling the liquid temperature, the stirrer rotation frequency, and the heating time, the shape as well as the variation coefficient of the shape coefficient was controlled. Further, by employing the classification in liquid, the particle diameter as well as the variation coefficient of the particle size distribution was optionally adjusted. Thus, toners Bk6 through Bk8 were prepared.

Toner Preparation Example 6

Example of a Suspension Polymerization Method

Yellow toners Y6 through Y8 were obtained by employing 10 g of C.I. Pigment Yellow 185 in place of carbon black in Preparation Example 5. Thus, toners Y6 through Y8 were prepared.

Toner Production Example 7

Example of a Suspension Polymerization Method

Magenta toners M6 through M8 were obtained by employing 10 g of quinacridone magenta pigment (C.I. Pigment Red 122) in place of carbon black in Preparation Example 2. Thus, toners M6 through M8 were prepared.

Toner Production Example 8

Example of a Suspension Polymerization Method

Cyan toners C6 through C8 were obtained by employing 10 g of phthalocyanine pigment (C.I. Pigment Blue 15:3) in place of carbon black in Preparation Example 2. Thus, toners C6 through C8 were prepared.

Toner Production Example 9

Example of a Suspension Polymerization Method

Black toner 9 having specific shape coefficient and particle size distribution characteristics as described in Table 1 in the similar manner to Preparation Example 2 excepted that reaction vessel as shown by FIGS. 9(*a*) and (*b*) having crossed axis a of 15° and classification by a centrifuge in liquid was omitted.

Toner Production Example 10

Example of a Suspension Polymerization Method

Yellow toners Y9 was obtained by employing 10 g of C.I. Pigment Yellow 93 in place of carbon black in Preparation Example 2.

Toner Production Example 11

Example of a Suspension Polymerization Method

Magenta toners M9 was obtained by employing 10 g of a quinacridone magenta pigment Carmine 6B in place of carbon black in Preparation Example 9.

Toner Production Example 12

Example of a Suspension Polymerization Method

Cyan toner C9 was obtained by employing 10 g of a phthalocyanine pigment C.I. Pigment Blue 15:3 in place of carbon black in Preparation Example 9.

Toner Production Example 10

Example of a Pulverization Method

Toner raw materials comprised of 100 kg of a styrene-n-butyl acrylate copolymer resin, 10 kg of carbon black, and 4 kg of polypropylene were preliminary mixed employing a Henschel mixer, and the resulting mixture was fuse-kneaded employing a biaxial extruder, preliminary pulverized employing a hammer mill, and further pulverized employing a jet method pulverizing unit. The resulting powder was dispersed (for 0.05 second at 200 to 300° C.) into the heated air flow of a spray drier to obtain shape adjusted particles. The resulting particles were repeatedly classified employing a forced air classifying unit until the targeted particle diameter distribution was obtained. Externally added to 100 weight parts of the obtained colored particles was one part of fine silica particles and mixed employing a Henschel mixer. Thus black toner Bk10, prepared employing the pulverization method, was obtained.

The shape as well as the variation coefficient of the shape coefficient was modified, and further, the particle diameter as well as the variation coefficient of the particle size distribution was modified in Example 10 described above. Thus black toners Bk10 and Bk11 shown in Table 1 were prepared.

Toner Production Example 14

Example of a Pulverization Method

Yellow toners Y10 and Y11 were obtained by employing 4 kg of C.I. Pigment Yellow 17 in place of carbon black in Preparation Example 13.

Toner Production Example 15

Example of a Pulverization Method

Magenta toners M10 and M11 were obtained by employing 4 kg of a quinacridone magenta pigment C.I. Pigment Red 122 in place of carbon black in Preparation Example 13.

Toner Production Example 16

Example of a Pulverization Method

Cyan toner C10 and C11 were obtained by employing 4 kg of a phthalocyanine pigment C.I. Pigment Blue 15:3 in place of carbon black in Preparation Example 13.

Shape characteristics and so on are listed in the following Tables.

TABLE 1

| Toner No. | Shape Co-efficient Ratio | Variation Coefficient the Shape Coefficient (%) | Shape Co-efficient Ratio of 1.2 to 1.6 (in %) | Ratio of Toner Particles Without Corners (in %) | Number Average Particle Diameter (in $\mu$m) | Sum M of $m_1$ and $m_2$ (in %) | Variation Coefficient of Particle Number Distribution (in %) |
|---|---|---|---|---|---|---|---|
| Bk1 | 1.54 | 13 | 86 | 85 | 5.3 | 72 | 25 |
| Y1 | 1.46 | 14 | 82 | 82 | 5.2 | 74 | 24 |
| M1 | 1.48 | 12 | 89 | 83 | 5.4 | 78 | 25 |
| C1 | 1.49 | 11 | 88 | 87 | 5.3 | 72 | 23 |
| Bk2 | 1.47 | 11 | 88 | 88 | 5.9 | 76 | 21 |
| Y2 | 1.43 | 12 | 88 | 88 | 5.9 | 78 | 20 |
| M2 | 1.44 | 13 | 89 | 89 | 5.8 | 75 | 21 |
| C2 | 1.41 | 10 | 90 | 88 | 5.9 | 75 | 21 |
| Bk3 | 1.37 | 14 | 79 | 78 | 5.2 | 72 | 23 |
| Y3 | 1.33 | 14 | 78 | 78 | 5.1 | 71 | 21 |
| M3 | 1.34 | 13 | 79 | 79 | 5.0 | 74 | 22 |
| C3 | 1.31 | 13 | 78 | 78 | 5.3 | 73 | 23 |
| Bk4 | 1.27 | 11 | 89 | 93 | 5.4 | 75 | 22 |
| Y4 | 1.29 | 11 | 87 | 92 | 5.7 | 75 | 21 |
| M4 | 1.28 | 12 | 89 | 91 | 5.5 | 76 | 21 |
| C4 | 1.28 | 11 | 88 | 93 | 5.5 | 76 | 20 |
| Bk5 | 1.10 | 10 | 59 | 94 | 5.3 | 62 | 32 |
| Y5 | 1.15 | 13 | 57 | 97 | 5.3 | 62 | 32 |
| M5 | 1.12 | 11 | 58 | 98 | 5.5 | 61 | 31 |
| C5 | 1.14 | 9 | 56 | 95 | 5.5 | 64 | 34 |
| Bk6 | 1.79 | 20 | 52 | 74 | 5.4 | 72 | 29 |
| Y6 | 1.78 | 21 | 53 | 77 | 5.4 | 72 | 28 |
| M6 | 1.76 | 21 | 54 | 75 | 5.4 | 71 | 29 |
| C6 | 1.81 | 19 | 55 | 74 | 5.6 | 74 | 27 |

TABLE 2

| Toner No. | Shape Co-efficient Ratio | Variation Coefficient the Shape Coefficient (%) | Shape Co-efficient Ratio of 1.2 to 1.6 (in %) | Ratio of Toner Particles Without Corners (in %) | Number Average Particle Diameter (in $\mu$m) | Sum M of $m_1$ and $m_2$ (in %) | Variation Coefficient of Particle Number Distribution (in %) |
|---|---|---|---|---|---|---|---|
| Bk7 | 1.31 | 12 | 69 | 89 | 5.6 | 79 | 18 |
| Y7 | 1.32 | 11 | 68 | 90 | 5.6 | 78 | 18 |
| M7 | 1.31 | 12 | 67 | 91 | 5.6 | 79 | 19 |
| C7 | 1.31 | 13 | 69 | 90 | 5.8 | 79 | 19 |
| Bk8 | 1.16 | 16 | 44 | 92 | 5.7 | 80 | 16 |
| Y8 | 1.16 | 15 | 45 | 92 | 5.7 | 81 | 14 |
| M8 | 1.17 | 14 | 46 | 93 | 5.5 | 83 | 15 |
| C8 | 1.13 | 15 | 46 | 96 | 5.7 | 84 | 14 |
| Bk9 | 1.31 | 11 | 71 | 90 | 5.6 | 76 | 20 |
| Y9 | 1.32 | 12 | 70 | 91 | 5.6 | 77 | 22 |
| M9 | 1.32 | 13 | 72 | 92 | 5.6 | 79 | 23 |
| C9 | 1.31 | 13 | 73 | 91 | 5.8 | 78 | 21 |
| Bk10 | 1.54 | 14 | 83 | 69 | 5.9 | 79 | 18 |
| Y10 | 1.52 | 14 | 82 | 65 | 5.5 | 78 | 18 |
| M10 | 1.52 | 12 | 83 | 61 | 5.7 | 79 | 17 |
| C10 | 1.53 | 13 | 83 | 63 | 5.9 | 79 | 19 |
| Bk11 | 1.58 | 19 | 73 | 52 | 5.6 | 63 | 36 |
| Y11 | 1.56 | 18 | 72 | 54 | 5.4 | 64 | 33 |
| M11 | 1.57 | 19 | 73 | 51 | 5.4 | 63 | 35 |
| C11 | 1.56 | 20 | 73 | 50 | 5.3 | 65 | 36 |

2. Production of Developer Materials and Image Forming Method

Developer materials 1 through 15 were prepared by mixing each of Toners with a 60 μm ferrite carrier coated with silicone resin for each color in the ratio to have toner content of 6% shown in Table 3.

Characteristics of the developers 1 through 15 are shown Table 3.

TABLE 3

| Developer | Combination of Toners | R1 | R2 | R3 | R4 |
|---|---|---|---|---|---|
| 1 | BK1/Y1/M1/C1 | 0.05 | 0.21 | 0.04 | 0.08 |
| 2 | BK2/Y2/M2/C2 | 0.04 | 0.15 | 0.02 | 0.05 |
| 3 | BK3/Y3/M3/C3 | 0.04 | 0.07 | 0.06 | 0.09 |
| 4 | BK4/Y4/M4/C4 | 0.02 | 0.08 | 0.05 | 0.09 |
| 5 | BK5/Y5/M5/C5 | 0.04 | 0.25 | 0.04 | 0.06 |
| 6 | BK6/Y6/M6/C6 | 0.03 | 0.10 | 0.04 | 0.07 |
| 7 | BK7/Y7/M7/C7 | 0.01 | 0.15 | 0.03 | 0.05 |
| 8 | BK8/Y8/M8/C8 | 0.03 | 0.13 | 0.04 | 0.12 |
| 9 | BK9/Y9/M9/C9 | 0.01 | 0.15 | 0.03 | 0.13 |
| 10 | BK10/Y10/M10/C10 | 0.01 | 0.14 | 0.03 | 0.11 |
| 11 | BK11/Y11/M11/C11 | 0.01 | 0.10 | 0.05 | 0.08 |
| 12 | BK1/Y2/M3/C4 | 0.17 | 0.15 | 0.15 | 0.20 |
| 13 | BK2/Y2/M3/C4 | 0.13 | 0.15 | 0.10 | 0.09 |
| 14 | BK3/Y2/M2/C3 | 0.10 | 0.14 | 0.12 | 0.13 |
| 15 | BK2/Y2/M5/C5 | 0.24 | 0.33 | 0.07 | 0.41 |

3. Evaluation of Image

Image formed on each of the first copy and 100,000th copy was measured. Image forming test was conducted in conditions of low temperature and low humidity (abbreviated LL condition, 10° C. and 20% RH), and high temperature and high humidity (abbreviated HH condition, 10° C. and 20% RH), in which characteristics variation was observed markedly.

(a) Color Difference

Color difference was measured by the following method.

The secondary colors (red, blue, and green) of the solid image portion in each of images formed on the first sheet and 100,000th sheet were measured by a "Macbeth Color-Eye 7000", and the color difference was calculated employing a CMC (2:1) color difference formula.

If the color difference obtained by the CMC (2:1) color difference formula was not more than 5, the variation of hue of the formed images was judged to be within the tolerance range.

(b) Reproduction of Fine Lines

Definition of line image formed by toner dots each of four colors was compared so as to evaluate the smoothness of image after transfer and fixing process. The definition was number of lines per mm of line image perpendicular to the direction of development recognized through a magnifier of 10 magnification.

The result is summarized in Tables 4 and 5.

TABLE 4

| Sample No. | Developer No. | Color Difference Initial | Color Difference 100,000th | Definition (lines/mm) Initial | Definition (lines/mm) 100,000th |
|---|---|---|---|---|---|
| Result of test in LL condition | | | | | |
| 1 | 1 | 1 | 1 | 8 | 8 |
| 2 | 2 | 1 | 1 | 8 | 8 |
| 3 | 3 | 1 | 2 | 8 | 8 |
| 4 | 4 | 1 | 2 | 8 | 8 |
| 5 | 7 | 1 | 2 | 8 | 8 |
| 6 | 9 | 1 | 1 | 8 | 8 |
| 7 | 10 | 3 | 4 | 8 | 7 |
| 8 | 12 | 1 | 1 | 8 | 8 |
| 9 | 13 | 2 | 2 | 8 | 8 |
| 10 | 14 | 2 | 2 | 8 | 8 |
| Comparative 1 | 5 | 4 | 8 | 6 | 5 |
| Comparative 2 | 6 | 5 | 9 | 6 | 3 |
| Comparative 3 | 8 | 4 | 6 | 6 | 5 |
| Comparative 4 | 11 | 5 | 8 | 6 | 5 |
| Comparative 5 | 15 | 5 | 9 | 6 | 4 |

TABLE 5

| Sample No. | Developer No. | Color Difference Initial | Color Difference 100,000th | Definition (lines/mm) Initial | Definition (lines/mm) 100,000th |
|---|---|---|---|---|---|
| Result of test in HH condition | | | | | |
| 1 | 1 | 1 | 1 | 8 | 8 |
| 2 | 2 | 1 | 1 | 8 | 8 |
| 3 | 3 | 1 | 2 | 8 | 8 |
| 4 | 4 | 1 | 2 | 8 | 8 |
| 5 | 7 | 1 | 2 | 8 | 8 |
| 6 | 9 | 1 | 1 | 8 | 8 |
| 7 | 10 | 3 | 4 | 8 | 7 |
| 8 | 12 | 1 | 1 | 8 | 8 |
| 9 | 13 | 2 | 2 | 8 | 8 |
| 10 | 14 | 2 | 2 | 8 | 8 |
| Comparative 1 | 5 | 4 | 8 | 6 | 5 |
| Comparative 2 | 6 | 5 | 9 | 6 | 3 |
| Comparative 3 | 8 | 4 | 6 | 6 | 5 |
| Comparative 4 | 11 | 5 | 8 | 6 | 5 |
| Comparative 5 | 15 | 5 | 9 | 6 | 4 |

Samples from 1 to 10 show low color difference and good image definition in both of initial and 100,000th copy.

What is claimed is:

1. An electrostatic photographic image forming method comprising:

a latent image corresponding to a first color image on a photoreceptor by a developer containing a toner having a first color to form the first image color;

developing a latent image corresponding to a second color image on the photoreceptor having the first color image by a developer containing a toner having a second color to form the second color image;

transferring the piled color images formed on the photoreceptor; and fixing the transferred piled color images, wherein the toner having the first color comprises first toner particles and the toner having the second color comprises second toner particles, and each of the first and second toner particles has a variation coefficient of the shape coefficient of not more than 16% and the number variation coefficient in the number particle diameter distribution of not more than 27%.

2. The electrostatic photographic image forming method of claim 1, further comprising:

developing a latent image corresponding to a third color image on the photoreceptor by a developer containing a toner having a third color, to form the third color image; and developing a latent image corresponding to a fourth color image on the photoreceptor by a developer containing a toner having a fourth color, to form the fourth color image;

wherein the toner having the third color comprises third toner particles and the toner having the fourth color comprises fourth toner particles, and each of the third and fourth toner particles has a variation coefficient of the shape coefficient of not more than 16% and the number variation coefficient in the number particle diameter distribution of not more than 27%.

3. The electrostatic photographic image forming method of claim 1, wherein a ratio of toner particles having a shape coefficient of from 1.2 to 1.6 is not less than 65% in number in each of the toner having the first color and the toner having the second color.

4. The electrostatic photographic image forming method of claim 1, wherein a ratio of the toner particle having no corner is not less than 50% in number in each of the toner having the first color and the toner having the second color.

5. The electrostatic photographic image forming method of claim 1, wherein a number average diameter of the toner particle is from 3 to 8 $\mu$m in each of the toner having the first color and the toner having the second color.

6. The electrostatic photographic image forming method of claim 1, wherein a number based histogram, in which natural logarithm lnD is taken as the abscissa and said abscissa is divided into a plurality of classes at an interval of 0.23, a toner exhibits at least 70 percent of the sum (M) of the relative frequency ($m_1$) of toner particles included in the highest frequency class, and the relative frequency ($m_2$) of toner particles included in the second highest frequency class wherein D is diameter of toner particles in each of the toner having the first color and the toner having the second color.

7. The electrostatic photographic image forming method of claim 2, wherein the toners having first, second, third and fourth colors are selected from the group consisting of a yellow, magenta, cyan and black toners.

8. The electrostatic photographic image forming method of claim 7, wherein the yellow, the magenta, the cyan and the black toners satisfy a condition of $$0 \leqq R1 \leqq 0.20$$

wherein

R1≦{(The maximum value of Ky, Km, Kc and Kb)−(The minimum value of Ky, Km, Kc and Kb)}/(The maximum value of Ky, Km, Kc and Kb), and Ky, Km, Kc and Kb each represents a shape coefficient of the yellow, the magenta, the cyan and the black toner, respectively.

9. The electrostatic photographic image forming method of claim 7, wherein the yellow, the magenta, the cyan and the black toners satisfy a condition of $$0 \leqq R2 \leqq 0.30$$

wherein

R2≦{(The maximum value of Kσy, Kσm, Kσc and Kσb)−(The minimum value of Kσy, Kσm, Kσc and Kσb)}/(The maximum value of Kσy, Kσm, Kσc and Kσb), and Kσy, Kσm, Kσc and Kσb each represents a variation coefficient of a shape coefficient of the yellow, the magenta, the cyan and the black toner, respectively.

10. The electrostatic photographic image forming method of claim 7, wherein the yellow, the magenta, the cyan and the black toners satisfy a condition of $$0 \leqq R3 \leqq 0.15$$

wherein

R3 {(The maximum value of Dy, Din, Dc and Db)−(The minimum value of Dy, Dm, Dc and Db)}/(The maximum value of Dy, Dm, Dc and Db), and Dy, Dm, Dc and Db each represents a number average of diameter of the yellow, the magenta, the cyan and the black toner, respectively.

11. The electrostatic photographic image forming method of claim 7, wherein the yellow, the magenta, the cyan and the black toners satisfy a condition of $$0 \leqq R4 \leqq 0.25$$

wherein

R4={(The maximum value of Dσy, Dσm, Dσc and Dσb)−(The minimum value of Dσy, Dσm, Dσc and Dσb)}/(The maximum value of Dσy, Dσm, Dσc and Dσb), and Dσy, Dσm, Dσc and Dσb each represents a number variation coefficient of a number distribution of diameter of the yellow, the magenta, the cyan and the black toner, respectively.

12. The image forming claim 2, wherein the first, second, third and fourth color images are piled on the photoreceptor and the piled color images are transferred to an image support at one time.

13. The electrostatic photographic image forming method of claim 2, wherein the transferring transfers the piled first, second, third and fourth color images on the photoreceptor to an image support.

14. The electrostatic photographic image forming method of claim 8, wherein the yellow, the magenta, the cyan and the black toners satisfy a condition of 0≦R3≦0.15, wherein R3={(The maximum value of Dy, Dm, Dc and Db)−(The minimum value of Dy, Dm, Dc and Db)}/(The maximum value of Dy, Dm, Dc and Db), and Dy, Dm, Dc and Db each represents a number average of diameter of the yellow, the magenta, the cyan and the black toner, respectively.

15. The electrostatic photographic image forming method of claim 14, wherein the yellow, the magenta, the cyan and the black toners satisfy a condition of 0≦R2≦0.30, wherein R2{(The maximum value of Kσy, Kσm, Kσc and Kσb)−(The minimum value of Kσy, Kσm, Kσc and Kσb)}/(The maximum value of Kσy, Kσm, Kσc and Kσb and Kσy, Kσm, Kσc and Kσb) each represents a variation coefficient of a shape coefficient of the yellow, the magenta, the cyan and the black toner, respectively, and a condition of 0≦R4≦0.25, wherein R4={(The maximum value of Dσy, Dσm, Dσc and Dσb)−(The minimum value of Dσy, Dσm, Dσc and Dσb)}/(The maximum value of Dσy, Dσm, Dσc and Dσb)), and Dσy, Dσm, Dσc and Dσb) each represents a number variation coefficient of a number distribution of diameter of the yellow, the magenta, the cyan and the black toner, respectively.

16. The electrostatic photographic image forming method of claim 2, wherein a ratio of toner particles having a shape coefficient of from 1.2 to 1.6 is not less than 65% in number in each of the toner having the first, second, third and fourth colors.

17. The electrostatic photographic image forming method of claim 2, wherein a ratio of the toner particle having no corner is not less than 50% in number in each of the toner having the first, second, third and fourth colors.

18. The image forming method of claim 1, wherein the at least one of the toners having the first and second colors comprises a compound represented by Formula:

$$R_1—(OCO—R_2)_n$$

wherein $R_1$ and $R_2$, each represents a hydrocarbon group having 1 to 40 carbon atoms and each may have a substituent, and n is an integer of 1–4.

19. The electrostatic photographic image forming method of claim 1, wherein both developing steps are performed by a non-contact developing method.

20. The image forming method of claim 15, wherein the at least one of the toners having the first, second, third and fourth colors comprises a compound represented by Formula:

$$R_1—(OCO—R_2)_n$$

wherein $R_1$ and $R_2$, each represents a hydrocarbon group having 1 to 40 carbon atoms and each may have a substituent, and n is an integer of 1–4.

* * * * *